US008943950B2

(12) United States Patent
Hartono et al.

(10) Patent No.: US 8,943,950 B2
(45) Date of Patent: Feb. 3, 2015

(54) RECIPROCATING PUMP FLOW CONTROL

(75) Inventors: Soegi Hartono, Coquitlam (CA); Vladimir Scekic, New Westminster (CA); Russell Turnbull, Coquitlam (CA)

(73) Assignee: MiVa Engineering Ltd., Burnaby (CA)

( * ) Notice: Subject to any disclaimer, the term of this patent is extended or adjusted under 35 U.S.C. 154(b) by 665 days.

(21) Appl. No.: 13/215,926

(22) Filed: Aug. 23, 2011

(65) Prior Publication Data

US 2012/0210865 A1 Aug. 23, 2012

Related U.S. Application Data

(60) Provisional application No. 61/376,606, filed on Aug. 24, 2010.

(51) Int. Cl.

| | |
|---|---|
| ***F01B 3/00*** | (2006.01) |
| ***F01B 1/02*** | (2006.01) |
| ***F01B 9/00*** | (2006.01) |
| ***F04B 15/02*** | (2006.01) |

(52) U.S. Cl.

CPC ..... *F04B 15/02* (2013.01); *F04B 2205/09* (2013.01)

USPC ..... 92/12.2; 92/73; 192/140

(58) Field of Classification Search

CPC ..... F04B 13/02; B05B 12/06

USPC ..... 92/12.2, 73, 69 R, 140; 417/215, 216, 417/427

See application file for complete search history.

(56) References Cited

U.S. PATENT DOCUMENTS

| | | | | |
|---|---|---|---|---|
| 3,672,460 | A * | 6/1972 | Takata | 180/420 |
| 4,228,656 | A * | 10/1980 | Frosch et al. | 60/518 |
| 4,240,256 | A * | 12/1980 | Frosch et al. | 60/518 |
| 4,808,077 | A * | 2/1989 | Kan et al. | 417/2 |
| 4,810,168 | A * | 3/1989 | Nogami et al. | 417/2 |
| 4,860,702 | A * | 8/1989 | Doundoulakis | 123/78 F |
| 6,783,331 | B2 * | 8/2004 | Lopes et al. | 417/216 |
| 2007/0148016 | A1 * | 6/2007 | Crawford et al. | 417/415 |
| 2008/0101970 | A1 * | 5/2008 | Witt et al. | 417/521 |
| 2009/0217904 | A1 * | 9/2009 | Lee et al. | 123/25 P |

* cited by examiner

*Primary Examiner* — Edward Look
*Assistant Examiner* — Daniel Collins
(74) *Attorney, Agent, or Firm* — Oyen Wiggs Green & Mutala LLP

(57) ABSTRACT

A multi-throw reciprocating pump is provided. The pump provides active stroke control. Fluid flow is controlled by canceling out at least a portion of a discharge stroke of one plunger with a suction stroke of another plunger. Controlling the degree to which the discharge stroke is cancelled out is used to control the actual volume of fluid being pumped.

7 Claims, 5 Drawing Sheets

| | | | | | |
|---|---|---|---|---|---|
| Phase Shift | deg | 0.00 | Effective Stroke Available for Flow | m | 0.4000 |
| Crank Radius | m | 0.1000 | Reduction in Effective Flow | | 0.00% |
| Connecting Rod Length | m | 0.4000 | | | |

| | | | | | |
|---|---|---|---|---|---|
| Phase Shift | deg | 51.67 | Effective Stroke Available for Flow | m | 0.3600 |
| Crank Radius | m | 0.1000 | Reduction in Effective Flow | | 10.00% |
| Connecting Rod Length | m | 0.4000 | | | |

| | | | | | |
|---|---|---|---|---|---|
| Phase Shift | deg | 120.00 | Effective Stroke Available for Flow | m | 0.2000 |
| Crank Radius | m | 0.1000 | Reduction in Effective Flow | | 50.00% |
| Connecting Rod Length | m | 0.4000 | | | |

| | | | | | |
|---|---|---|---|---|---|
| Phase Shift | deg | 180.00 | Effective Stroke Available for Flow | m | 0.0234 |
| Crank Radius | m | 0.1000 | Reduction in Effective Flow | | 93.65% |
| Connecting Rod Length | m | 0.4000 | | | |

RECIPROCATING PUMP FLOW CONTROL

TECHNICAL FIELD

This invention relates to flow control devices, and more particularly to flow control devices in reciprocating pumps used for example in, but not limited to, mud-pumping and frac-pumping applications in the oil-and-gas industry.

BACKGROUND

Reciprocating pumps are commonly used in applications where high volumes of fluid need to be pumped at high pressures. Highest efficiency reciprocating pumps are commonly driven by a crank mechanism. Since any given crank mechanism provides for a constant stroke of the plunger, two methods are typically used for controlling volumetric flow of these pumps:

- changing the liner/plunger size, since liners and plungers of smaller diameter fill provide for less flow per stroke of the pump and vice versa,
- changing the speed of the pump, since slowing down the pump will result in fewer "strokes per minute" which will result in less flow of fluid and vice versa.

Both methods have limitations. Changing the liners and plungers is labour-intensive and requires skilled labour, and the pump must be taken out of service during changing, resulting in "down time" of the pump. Controlling the speed may be practical within a limited range if a diesel or gas engine is being used as a prime mover. However, if an electric motor is used as a prime mover, very expensive and inefficient speed controls need to be used, such as VFD or DC controllers.

In order to achieve an appropriate match between pumping requirements and capabilities of the engines used as prime movers, expensive, multispeed transmissions are often used, especially in frac-pump applications where they are often 6, 7 or even 8-speed units. Mud-pumping applications often use 2-speed transmissions. Furthermore, shifting between speeds can result in momentary interruptions in fluid flow.

There is a need for improved apparatus and methods for controlling the volumetric flow of fluid discharged from reciprocating pumps.

SUMMARY

In one aspect of the invention, a reciprocating pump is provided. The reciprocating pump includes: a first sleeve defining a first compression chamber; a first plunger receivable in the first sleeve; a second sleeve defining a second compression chamber, the second compression chamber in fluid communication with the first compression chamber; a second plunger receivable in the second sleeve; at least one outlet and at least one inlet in fluid communication with both the first and second compression chambers; a first crankshaft coupled to the first plunger, the first crankshaft drivingly coupled to a prime mover; a second crankshaft coupled to the second plunger, the second and first crankshafts coupled to each other through a differential and rotatable about a common crankshaft axis; a differential housing for housing the differential, the differential housing rotatable about the common crankshaft axis; rotation means for rotating the differential housing; whereby rotation of the differential housing effects a phase shift between strokes of the first and second plungers to modulate effective flow of fluid out of the outlet.

BRIEF DESCRIPTION OF THE DRAWINGS

In drawings which show non-limiting embodiments of the invention.

DETAILED DESCRIPTION

It will be appreciated that numerous specific details are set forth in order to provide a thorough understanding of the exemplary embodiment described herein. However, it will be understood by those of ordinary skill in the art that the embodiments described herein may be practiced without these specific details. In other instances, well-known methods, procedures and components have not been described in detail so as not to obscure the embodiment described herein. Furthermore, this description is not to be considered as limiting the scope of the embodiment described herein in any way, but rather as merely describing the implementation of the embodiment described herein.

The invention provides apparatus and methods for active stroke control for controlling fluid flow of multi-throw reciprocating pumps. Fluid flow is controlled by canceling out at least a portion of a discharge stroke of one plunger with a suction stroke of another plunger. Controlling the degree to which the discharge stroke is cancelled out is used to control the actual volume of fluid being pumped.

Some embodiments provide pumps with an even number of throws (2, 4, 6, etc.) while other embodiments provide pumps with any number of throws. Those skilled in the art will understand that:

- Pumps with an even number of plungers higher than 2 (4, 6, 8, etc.) may be controlled by providing one or more "pairs" of plungers; and
- Pumps with an odd number of plungers (3, 5, 7, etc.) may be controlled by "pairing" some plungers for control while leaving one or more plungers uncontrolled (e.g. always acting at full-flow).

The term "pair" of plungers as used in this specification refers to two plungers each connected to their respective crankshafts, for example by means of cross-heads and connecting rods, and the crankshafts connected to each other by means of a differential gear arrangement in any known manner such that the phase of stroke may be varied between the two plungers. Compression chambers of the pair of plungers may be connected in any manner that provides minimal restriction to the flow of fluid between the compression chambers.

Figure 1:
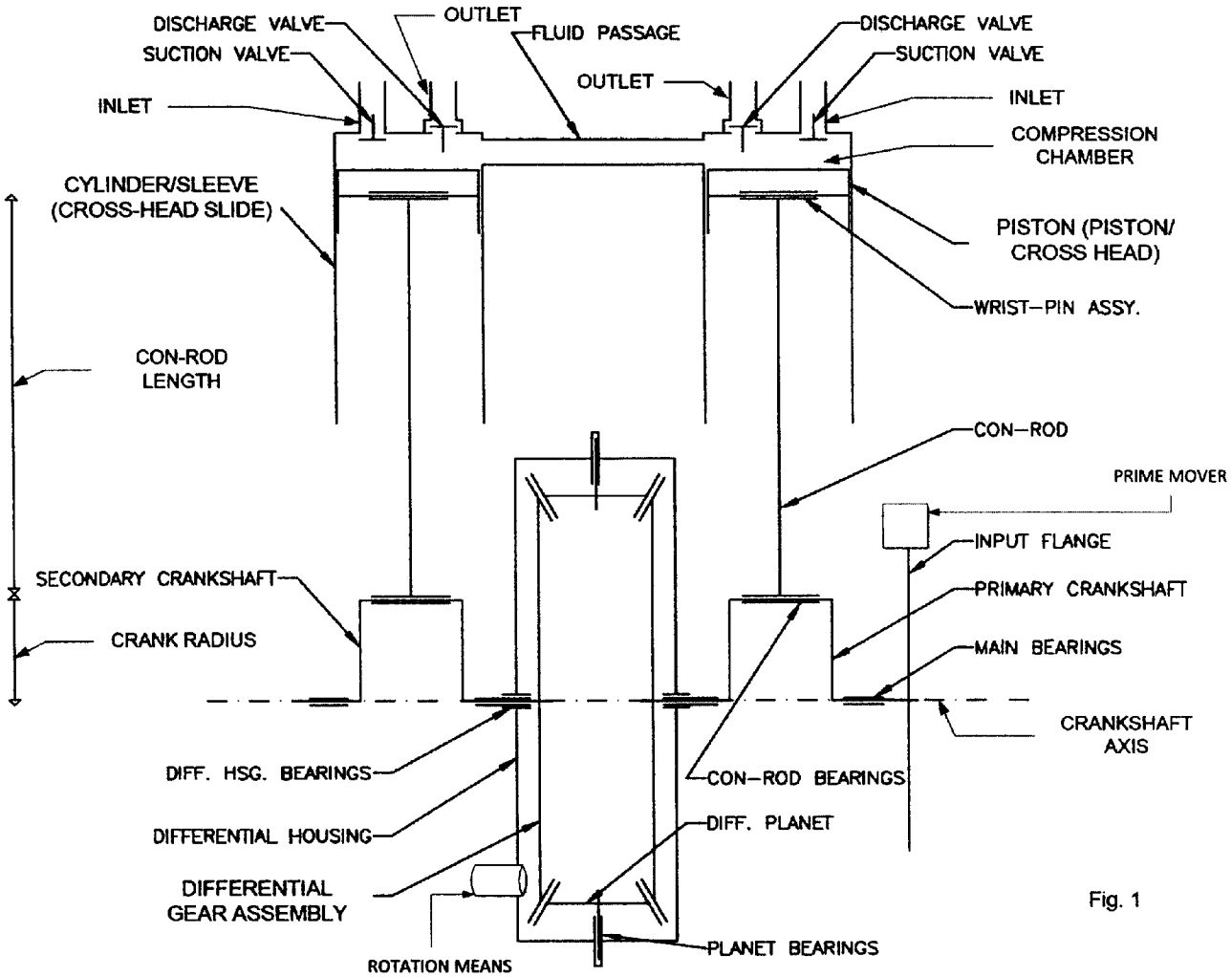
FIG. 1 is a schematic view of one embodiment according to the present invention.

The description will describe apparatus and methods for controlling a two-plunger pump as an example. FIG. 1 shows a schematic representation of a two-plunger reciprocating pump according to one embodiment of the invention. The pump features a phase control method of active stroke control, as described further below. For reasons of simplicity and ease of understanding, FIG. 1 shows the pistons and cross-heads are shown as pistons acting upon the fluid. It will be understood by those with ordinary skill in the art that those pistons can be cross-heads that will then be connected to the actual plungers of the pump. In other embodiments cross-heads may be absent and the piston may directly connect to the connecting rod.

Respective compression chambers of the pump (shown above the two pistons/plungers in FIG. 1) are in fluid communication with each other through a fluid passage.

The crankshaft of the pump is divided into a primary crankshaft and a secondary crankshaft. Each of the primary crankshaft and secondary crankshaft actuate one connecting rod and one piston (i.e., a plunger). The primary and secondary crankshafts are coupled by means of a differential, such as a differential gear assembly. The differential gear assembly is housed in a differential housing. As shown in FIG. 1, the primary crankshaft is driven by a prime mover through an input flange for example. The primary crankshaft, in turn, provides driving torque to the secondary crankshaft through the differential gear assembly.

The differential housing is supported in differential housing bearings in such a manner that it may be rotated in a controlled manner around an axis common with the crankshaft, i.e., the crankshaft axis. The rotation means (not shown) used to control such movement may be one of any number of mechanisms known to those of ordinary skill in the art. For example, rotation means may include a worm gear coupled to the differential housing and driven by a motor or the like.

Figure 2:
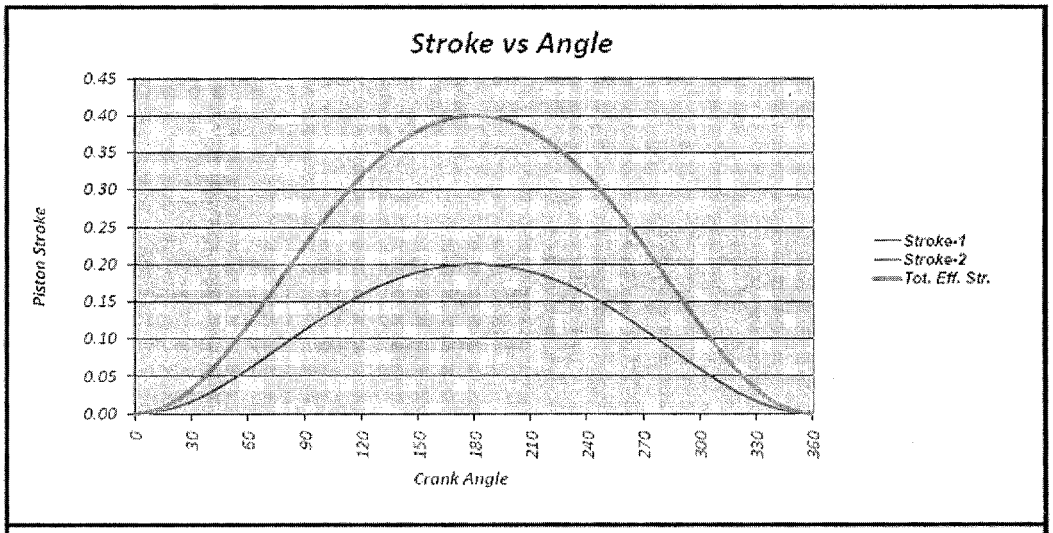
FIGS. 2 to 5 are tables and graphs illustrating the effective stroke, reduction in effective flow, the relationship between piston stroke and crank angle, and the relationship between piston speed and crank angle, at stroke phase shifts of 0, 51.76, 120, and 180 degrees respectively, in one embodiment according to the present invention.
Figure 2:
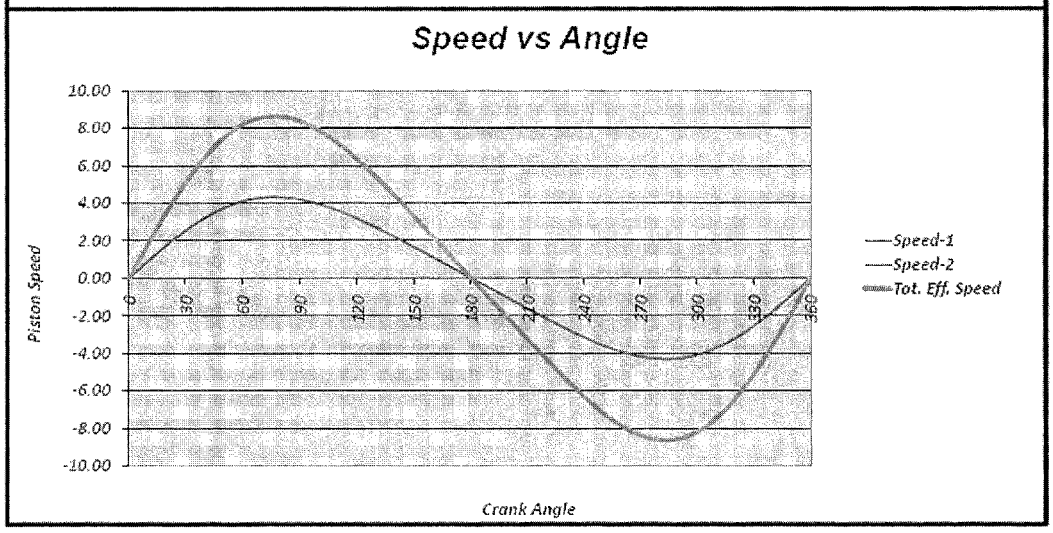

The two throws of the crankshaft are in phase in FIG. 1, meaning that the two plungers will travel in synchrony between top dead centre (TDC) and bottom dead centre (BDC). When the differential housing is held against rotation around the crankshaft axis, the primary and secondary crankshafts will rotate in opposite directions, but the plungers will reach TDC and BDC at the same time. At any moment in time, pressures above the plungers will be substantially the same, and thus no transfer of fluid between the two compression chambers will occur. All of the fluid will be forced out through the discharge valves. This situation will correspond to maximum flow of the pump, and is described graphically in FIG. 2 with respect to one embodiment of the invention. Since there are two plungers, the effective stroke will be equal to twice the actual stroke of each plunger and the total effective speed will be equal to twice the actual speed of each plunger.

The differential housing may be rotated away from the in phase position, around the crankshaft axis, and then held in a new angular position to effect a "phase shift" between the two plungers. The phase shift will be equal to twice the angle of the rotation of the housing. For example, to achieve a 50 degree phase shift, the differential housing must be rotated by 25 degrees.

Since the path of a stroke of the plunger resembles a sinusoid, once the phase-shift occurs, the plungers will "follow" each other along the sinusoid. Accordingly, there will be instances where one plunger is moving "up" (i.e., in the discharge stroke) while the other one is moving "down" (i.e., in the suction stroke). During these instances, at least a portion of the fluid will be flowing between the two compression chambers through the fluid passage rather than out the discharge valves, thus reducing the effective discharge flow of the pump.

Figure 3:
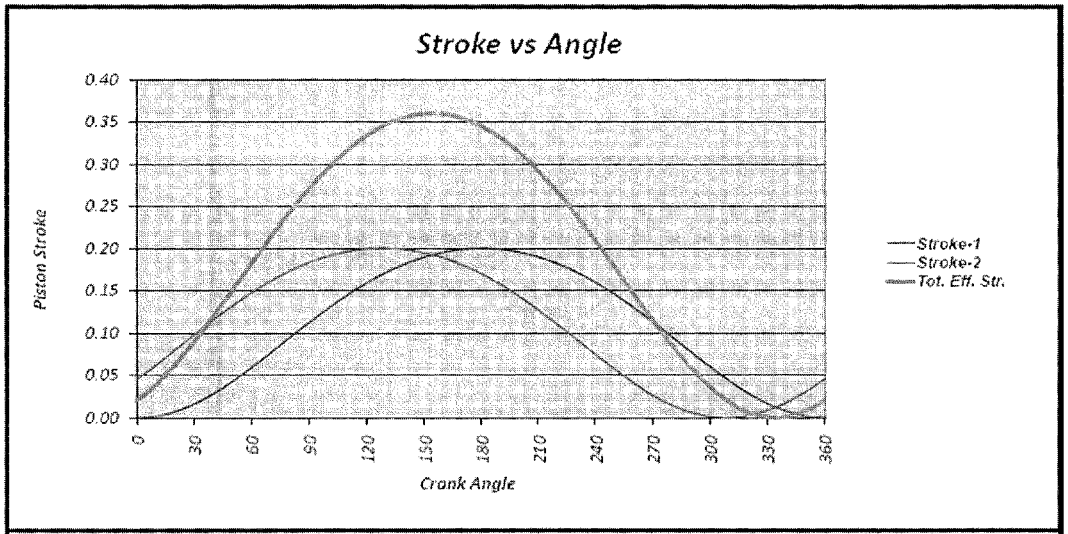
Figure 3:
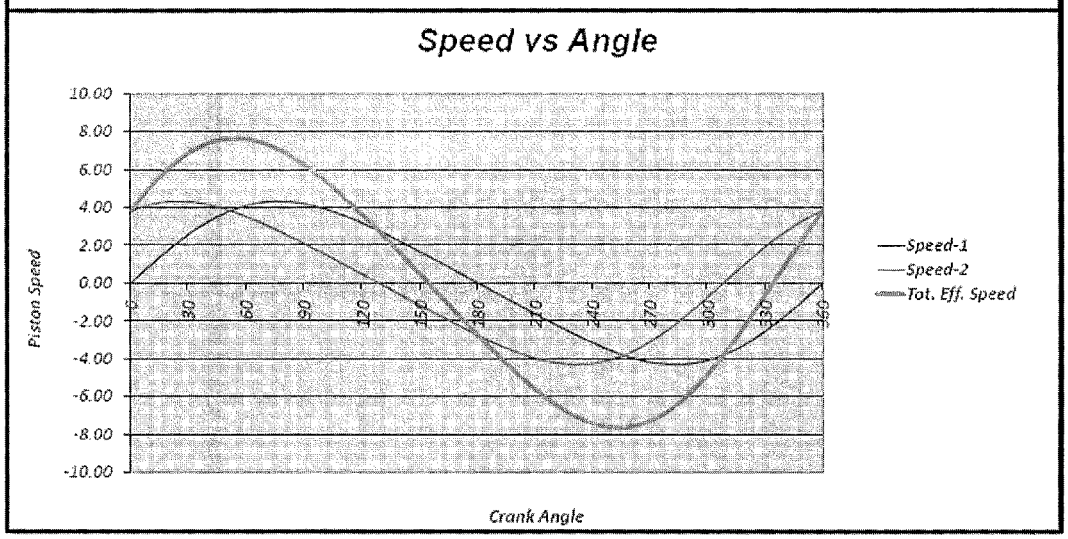
Figure 4:
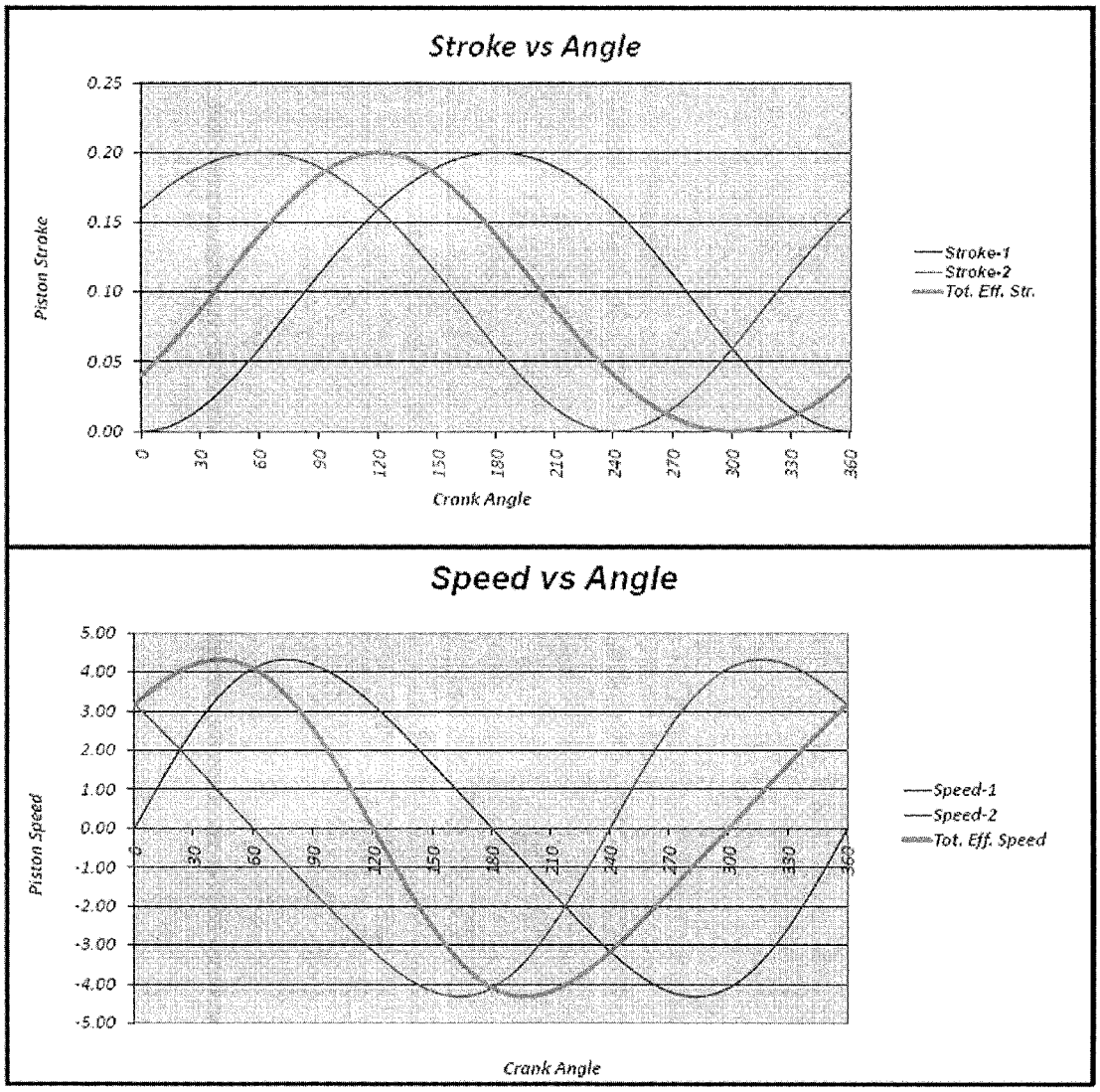
Figure 5:
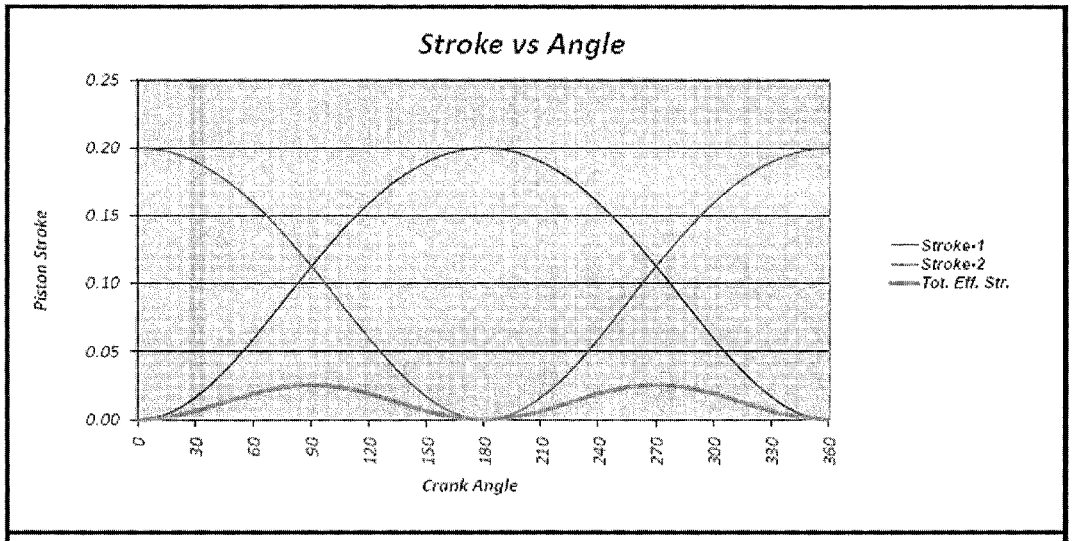
Figure 5:
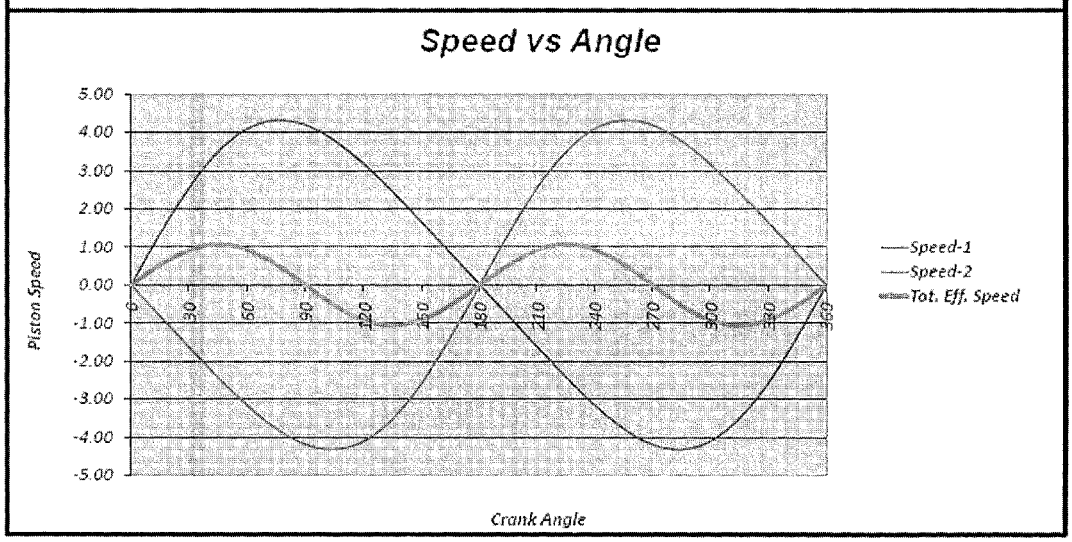

Increasing the phase shift will increase the flow between the compression chambers to reduce the effective flow of the pump. FIGS. 3 and 4 graphically describe reduction of effective flow with phase shifts of 51.67 and 120 degrees respectively. Maximum reduction of effective flow occurs with a phase shift of 180 degrees, where very little fluid will flow out the discharge valves, as graphically described in FIG. 5. A phase shift of 180 degrees does not result in 100% flow reduction because the actual percentage of flow reduction will depend on pump geometry, in particular the ratio of connecting rod length to crank throw length (i.e., crank radius). The ratio of connecting rod length to crank throw length is positively correlated with the actual percentage of flow reduction.

Because phase shifting merely requires rotation of the differential housing about the crankshaft axis, simple and uninterrupted flow control is achieved. Once a desired effective flow is achieved, the differential housing may for example be locked in that angular position until further adjustment is required.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The invention claimed is:

1. A reciprocating pump comprising:

(a) A first sleeve defining a first compression chamber;

(b) A first plunger receivable in the first sleeve;

(c) A second sleeve defining a second compression chamber, the second compression chamber in fluid communication with the first compression chamber;

(d) A second plunger receivable in the second sleeve;

(e) At least one outlet and at least one inlet in fluid communication with both the first and second compression chambers;

(f) A first crankshaft coupled to the first plunger, the first crankshaft drivingly coupled to a prime mover;

(g) A second crankshaft coupled to the second plunger, the second and first crankshafts coupled to each other through a differential and rotatable about a common crankshaft axis;

(h) a differential housing for housing the differential, the differential housing rotatable about the common crankshaft axis;

(i) rotation means for rotating the differential housing;

whereby rotation of the differential housing effects a phase shift between strokes of the first and second plungers ranging from −180° to 180° to modulate effective flow of fluid out of the outlet.

2. A pump according to claim 1 wherein the differential comprises a differential gear assembly.

3. A pump according to claim 2 wherein the differential gear assembly comprises a differential planet gear.

4. A pump according to claim 1 wherein the first plunger is coupled to the first crankshaft by a first connection rod, and the second plunger is coupled to the second crankshaft by a second connection rod.

5. A pump according to claim 1 wherein the first compression chamber and the second compression chamber are in fluid communication through a fluid passage.

6. A pump according to claim 5 wherein the fluid passage is located adjacent to the at least one outlet.

7. A pump according to claim 1 wherein the rotation means comprises a worm gear driven by a motor.

* * * * *